US012221843B1

(12) United States Patent
Xu et al.

(10) Patent No.: US 12,221,843 B1
(45) Date of Patent: Feb. 11, 2025

(54) AUTOMATIC DETECTION FUNCTION-INTEGRATED DETECTION APPARATUS AND METHOD FOR WATER FLOWING FRACTURED ZONE

(71) Applicant: SICHUAN UNIVERSITY, Chengdu (CN)

(72) Inventors: Nuwen Xu, Chengdu (CN); Zhuang Li, Chengdu (CN); Biao Li, Chengdu (CN); Peiwei Xiao, Chengdu (CN); Rong Yang, Chengdu (CN); Yong Xia, Chengdu (CN); Bei Jiang, Chengdu (CN); Haoyu Mao, Chengdu (CN); Xinchao Ding, Chengdu (CN); Guo Liao, Chengdu (CN); Zhi Li, Chengdu (CN); Yuepeng Sun, Chengdu (CN); Zhiqiang Sun, Chengdu (CN); Sen Yang, Chengdu (CN)

(73) Assignee: SICHUAN UNIVERSITY, Chengdu (CN)

( * ) Notice: Subject to any disclaimer, the term of this patent is extended or adjusted under 35 U.S.C. 154(b) by 0 days.

(21) Appl. No.: 18/762,783

(22) Filed: Jul. 3, 2024

Related U.S. Application Data

(63) Continuation of application No. PCT/CN2024/080351, filed on Mar. 6, 2024.

(30) Foreign Application Priority Data

Jan. 31, 2024 (CN) ..... 202410129368.1

(51) Int. Cl.
*E21B 21/08* (2006.01)
*E21B 33/127* (2006.01)
*E21B 43/26* (2006.01)

(52) U.S. Cl.
CPC ..... *E21B 21/08* (2013.01); *E21B 33/127* (2013.01); *E21B 43/26* (2013.01)

(58) Field of Classification Search
CPC ..... E21B 21/08; E21B 43/26; E21B 33/127
See application file for complete search history.

(56) References Cited

U.S. PATENT DOCUMENTS 8,763,411 B2 * 7/2014 Wray ..... F28D 7/10 62/67

FOREIGN PATENT DOCUMENTS

CN 1062974 A 7/1992

* cited by examiner

*Primary Examiner* — Catherine Loikith
(74) *Attorney, Agent, or Firm* — Bayramoglu Law Offices LLC

(57) ABSTRACT

An automatic detection function-integrated detection apparatus includes a drill rod and an elastic water storage bag; two sides of the drill rod are a head region and a tail region, respectively; an interior of the drill rod has a water supply channel, a side wall of the drill rod is provided with a first channel, and a first valve is disposed in the first channel. The automatic detection function-integrated detection apparatus and method for the water flowing fractured zone may complete the detection of the water flowing fractured zone while drilling, and thus the labor intensity of workers may be reduced.

18 Claims, 4 Drawing Sheets

AUTOMATIC DETECTION FUNCTION-INTEGRATED DETECTION APPARATUS AND METHOD FOR WATER FLOWING FRACTURED ZONE

CROSS REFERENCE TO THE RELATED APPLICATIONS

This application is a continuation application of International Application No. PCT/CN2024/080351, filed on Mar. 6, 2024, which is based upon and claims priority to Chinese Patent Application No. 202410129368.1, filed on Jan. 31, 2024, the entire contents of which are incorporated herein by reference.

TECHNICAL FIELD

The present application relates to the technical field of water flowing fractured zone detection and, more particularly, to an automatic detection function-integrated detection apparatus and method for a water flowing fractured zone.

BACKGROUND

In the process of coal mining, as the coal is extracted and the overlying strata move into the free space, a certain range of fractures develop above the roof. When there is a rich aquifer above the coal seam, whether the fracture range is communicated with the aquifer determines the safety of the working face. Therefore, determining a development range of the fracture above the coal seam of great significance in ensuring safe and efficient coal mining.

The Chinese patent application (CN1062974A) discloses a drill hole sectional water injection and inflation leakage detection technology and discloses a double-end water plugging device and a method for injecting water into a drill hole using the double-end water plugging device to determine a development condition of a water flowing fractured zone through a water leakage condition of the drill hole. A structure of the double-end water plugging device is that water-filled capsules and rubber ring check valves of a principle of valve cores are installed at two ends of a connecting pipe, a rubber pipe is connected to the double-end water plugging device and pushed into the drill hole by using a rod, and a lower end of the rubber pipe is connected to a water injection observation apparatus. In this apparatus, water is injected into plugging sections in the capsules at two ends, and the development state of the fracture is determined by observing the water injection pressure and the change of water flow per unit time.

The disadvantage of this method is that during the measurement with the double-end water plugging device, a drill hole needs to be completed first, and then a measurement apparatus is sent to a test position by a drill rod for testing, and the drill rod needs to be loaded and unloaded twice during this process, the amount of labor of workers is greatly increased.

Therefore, the present application provides a technical solution for overcoming the above-mentioned deficiencies of the prior art.

SUMMARY

An object of the present application is to provide an automatic detection function-integrated detection apparatus and method for a water flowing fractured zone and solve the problem existing in the prior art that a drill rod needs to be loaded and unloaded twice during a detection process, the amount of labor of workers is greatly increased.

The advantages and beneficial effects of embodiments of the present application are as follows:

In a first aspect of some embodiments of the present application, an automatic detection function-integrated detection apparatus for a water flowing fractured zone is provided, which includes a drill rod and an elastic water storage bag located at a periphery of a middle portion of the drill rod, wherein a region of the drill rod covered by the elastic water storage bag is a plugging region, and two sides of the plugging region are a head region and a tail region, respectively;

an interior of the drill rod has a water supply channel arranged in an axial direction; a terminal end of the head region is provided with a drill bit, and a terminal end of the tail region is configured to connect a drilling machine; a side wall of the drill rod is provided with a first channel communicating an interior of the elastic water storage bag with the water supply channel, and a first valve is disposed in the first channel; the drill rod in the head region is provided with a second channel communicating the water supply channel with an outside of the drill rod, and a first flowmeter and a second valve are disposed in the water supply channel between the second channel and the elastic water storage bag; a water return pipeline is arranged between the head region and the tail region of the drill rod, and the water return pipeline passes through the elastic water storage bag and communicates an outside of the head region of the drill rod with an outside of the tail region; a second flowmeter is disposed in the water return pipeline.

In an optional embodiment of the present application, a first overflow valve is disposed in the water return pipeline.

In an optional embodiment of the present application, the water return pipeline is U-shaped and includes a first pipe, a second pipe, and a third pipe that are vertically connected to each other; the first pipe and the third pipe are located in the side wall of the drill rod in the head region and the tail region, respectively, and the second pipe is located in the water supply channel; and/or a middle portion of the first channel is connected to a third channel, and a terminal end of the third channel is communicated with the outside of the tail region; a second overflow valve is disposed in the third channel.

In an optional embodiment of the present application, a drill rod controller is disposed at an outer side of the drill rod and is connected to the first flowmeter, the second flowmeter, the first valve, and the second valve.

In an optional embodiment of the present application, the drill rod controller is connected to an external control apparatus.

In an optional embodiment of the present application, the elastic water storage bag is made of rubber; and/or a terminal end of the drill rod in the tail region is connected to one end of a transfer drill rod via threads, and the other end of the transfer drill rod is connected to the drilling machine; and/or the first valve and the second valve are solenoid valves.

In a second aspect of some embodiments of the present application, an automatic detection function-integrated detection method for the water flowing fractured zone is provided, the automatic detection function-integrated detection apparatus for the water flowing fractured zone according to any one of embodiments in the first aspect is adopted in the method, the method includes the following steps:

step A, connecting the terminal end of the head region of the drill rod to the drill bit, and connecting the terminal end of the tail region to the drilling machine; introducing water into the water supply channel, keeping the first valve closed, and opening the second valve; starting the drilling machine, drilling to a position needed to be detected, and then stopping drilling;

step B, controlling a drill rod controller on the drill rod through an external control apparatus outside a drill hole, so that the drill rod controller closes the second valve and opens the first valve; filling the elastic water storage bag with the water through the first channel to expand the elastic water storage bag outwards and close the drill hole;

step C, controlling the drill rod controller through the external control apparatus outside the drill hole, so that the drill rod controller opens the second valve and closes the first valve;

importing the water into a space between the head region and the drill hole through the second channel, and flowing the water out to the tail region through the water return pipeline after the space is filled with the water;

step D, recording flow data of the first flowmeter and the second flowmeter per unit time to obtain a first flow value and a second flow value; and step E, stopping supplying the water into the water supply channel, and controlling the drill rod controller through the external control apparatus outside the drill hole, so that the drill rod controller opens the first valve; closing the first valve after the elastic water storage bag is closely attached to the drill rod, and continuing drilling to a next detection position.

In an optional embodiment of the present application, in the step A, a maximum length of the drill hole is determined by calculating a maximum development height of the water flowing fractured zone; and/or in the step B, the elastic water storage bag is filled with the water through the first channel until a second overflow valve in a third channel connected to the first channel is opened and a signal is fed back; and/or in the step C, after a first overflow valve in the water return pipeline is opened and a signal is fed back, the step D is performed.

In an optional embodiment of the present application, in the step D, whether the position needed to be detected contains a fracture is determined based on a ratio of the first flow value to the second flow value, a development degree Δ of the fracture is acquired at the position needed to be detected, and a calculation formula of the development degree of the fracture is as follows:

$$\frac{q_1}{q_2} \cdot k = \Delta,$$

wherein Δ is a development degree of a fracture of a drill hole detection section, $q_1$ is the second flow value, $q_2$ is the first flow value, and k is a pressure correction coefficient;

when $\Delta \geq 0.9$, the fracture of the drill hole detection section is almost undeveloped, and a drill hole detection position is determined to be in a complete section;

when $0.9 > \Delta \geq 0.5$, the development degree of the fracture of the drill hole detection section is slow, and it is determined that there is a fracture at the drill hole detection position, but the development degree of the fracture is not serious;

when $0.5 > \Delta \geq 0.2$, the development degree of the fracture of the drill hole detection section is relatively serious, and the drill hole detection position is determined to be close to a development range of the water flowing fractured zone;

when $\Delta < 0.2$, the development degree of the fracture of the drill hole detection section is serious, and the drill hole detection position is determined to be in the development range of the water flowing fractured zone.

In an optional embodiment of the present application, the pressure correction coefficient k is 1.

The advantages and beneficial effects of the embodiments of the present application are:

according to the automatic detection function-integrated detection apparatus and method for the water flowing fractured zone provided by the embodiments of the present application, an automatic detection apparatus is integrated on a drill rod, and the detection of the water flowing fractured zone may be completed while drilling, thus the labor intensity and detection time of workers are greatly reduced. In addition, by controlling a hydrostatic pressure of a detection position, an observation result of the water flowing fractured zone may be accurately determined, the accuracy of the observation result of the water flowing fractured zone is improved and reduces the limitation of the uncertainty of the observation result of the water flowing fractured zone caused by a traditional double-end water plugging device.

BRIEF DESCRIPTION OF THE DRAWINGS

In order to more clearly illustrate the technical solutions of the embodiments of the present application or the related art, the figures that are required to describe the embodiments or the related art will be briefly described below. Apparently, the figures that are described below are merely some embodiments of the present application, and a person skilled in the art can obtain other figures according to these figures without paying creative work.

Reference numbers are described below:

1—drill rod; 10—water supply channel; 11—first channel; 12—second channel; 13—third channel; 2—clastic water storage bag; 3—drill bit; 4—drilling machine; 51—first valve; 52—second valve; 61—first flowmeter; 62—second flowmeter; 7—water return pipeline; 71—first pipe; 72—second pipe; 73—third pipe; 81—first overflow valve; 82—second overflow valve; 9—drill rod controller; 91—external control apparatus; 101—coal seam; 102—rock stratum; and 103—curve.

DETAILED DESCRIPTION OF THE EMBODIMENTS

In order to make the purpose, technical solution and advantages of embodiments of the present disclosure clearer, the technical solutions of the embodiments of the present application will be clearly and completely described below with reference to the drawings of the embodiments of the present application. Obviously, the described embodiments are a part of the embodiments of the present disclosure, not all embodiments. Based on the embodiments in the present disclosure, all other embodiments obtained by those of ordinary skill in the art without paying creative labor fall within the scope of protection of the present disclosure.

In the description of the present application, the terms "first", "second", and the like do not indicate any order, number, or importance, but are used only to distinguish between different components. The terms "including", "containing", and the like are intended to mean that the elements or objects appearing before the term encompass the elements or objects listed after the term and their equivalents, without excluding other elements or objects. The terms "longitudinal", "transverse", "up", "down", "front", "back", "left", "right", "vertical", "horizontal", "top", "bottom", and the like indicate orientations or positional relationships based on those shown in the accompanying drawings and are intended only to facilitate the description of the present application rather than to require that the present application must be constructed and operated in a particular orientation, and therefore are not to be construed as a limitation of the present application. The terms "linked", "connected", and "provided" used in the present application should be broadly interpreted, for example, a fixed connection or a removable connection, a direct connection or an indirect connection through an intermediate member, a wired electrical connection, a wireless electrical connection, or a wireless communication signal connection. A person skilled in the art may understand the specific meanings of the above-mentioned terms according to specific situations.

Figure 1:
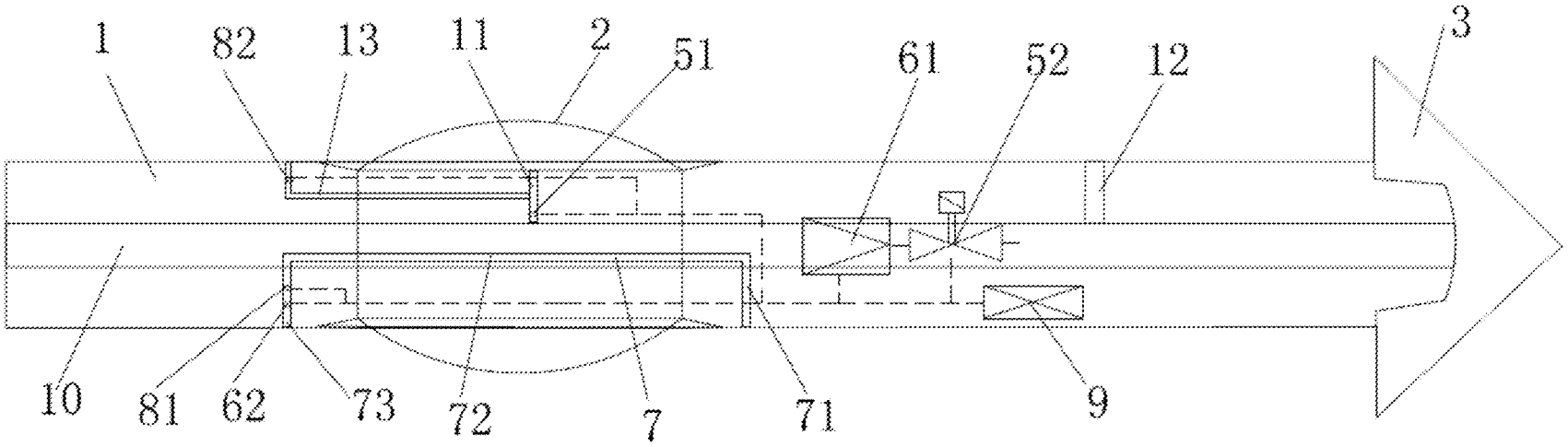
FIG. 1 is a schematic structural diagram of an automatic detection function-integrated detection apparatus for a water flowing fractured zone according to an embodiment of the present application.
Figure 2:
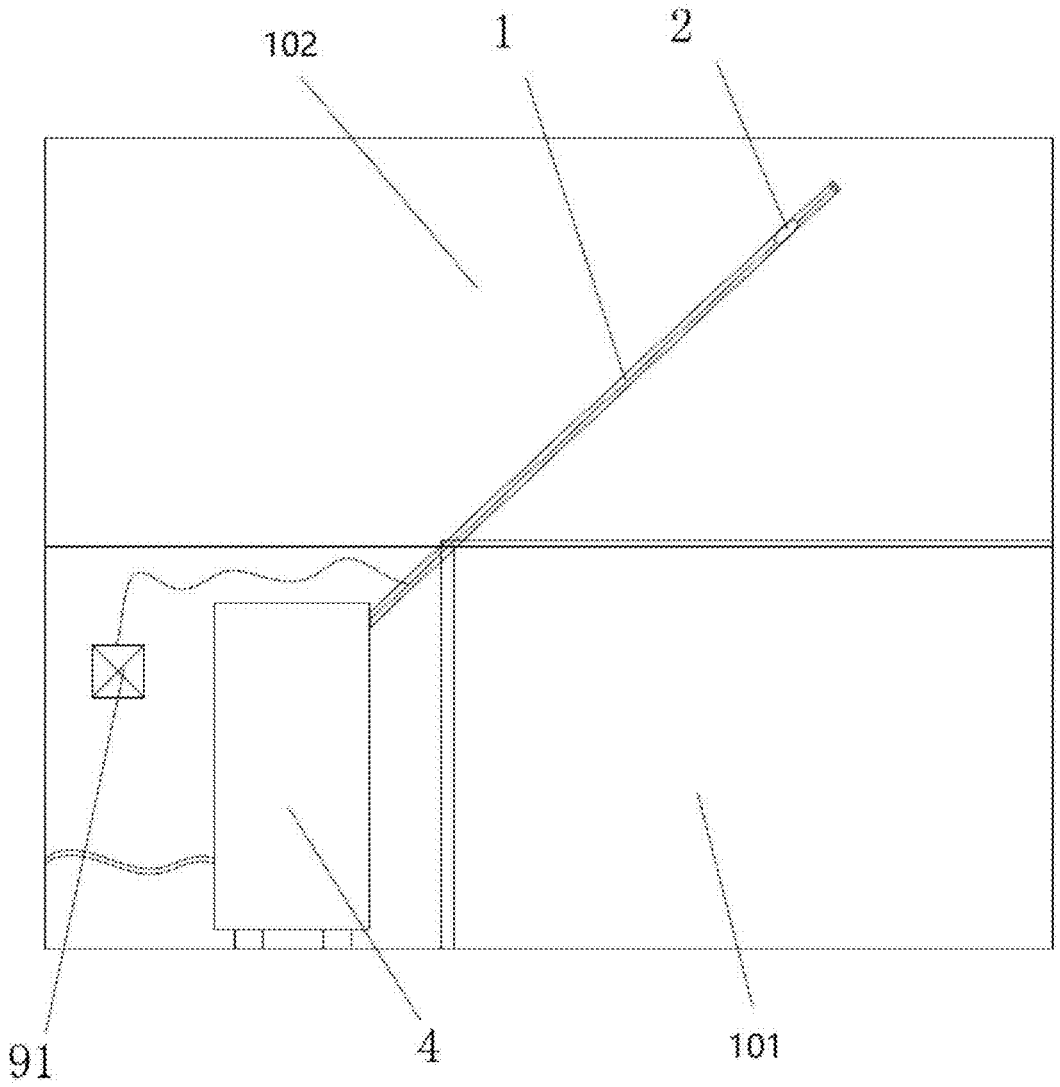
FIG. 2 is a schematic diagram of a state of use of an automatic detection function-integrated detection apparatus for a water flowing fractured zone according to an embodiment of the present application.

In a first aspect, an automatic detection function-integrated detection apparatus for a water flowing fractured zone is provided by the embodiment of the present application. Referring to FIG. 1 and FIG. 2, FIG. 1 is a schematic structural diagram of an automatic detection function-integrated detection apparatus for a water flowing fractured zone according to an embodiment of the present application, and FIG. 2 is a schematic diagram of a state of use of an automatic detection function-integrated detection apparatus for a water flowing fractured zone according to an embodiment of the present application. The apparatus includes a drill rod 1 and an elastic water storage bag 2 located at a periphery of a middle portion of the drill rod 1. A material of the clastic water storage bag 2 is preferably rubber. When in use, the drill rod 1 and the elastic water storage bag 2 are located in a drill hole, and an interior of the elastic water storage bag 2 can be filled with water and expanded, thereby the drill hole of this part is plugged. A region of the drill rod 1 covered by the clastic water storage bag 2 is a plugging region, and regions of the drill rod 1 located at two sides of the plugging region are a head region and a tail region, respectively. A length of the head region is preferably 1 m, and the length of the head region is merely an exemplary illustration and is not limited thereto, but is only based on actual needs.

An interior of the drill rod 1 has a water supply channel 10 arranged in an axial direction. The water supply channel 10 is connected to a water source, for example, the water supply channel may be connected to a water supply pipe through a rotary joint at a terminal end of the tail region of the drill rod 1. A terminal end of the head region is provided with a drill bit 3 for drilling to form a drill hole, and the terminal end of the tail region is configured to connect a drilling machine 4 for rotating the drill rod 1 and drilling. Preferably, a diameter of the drill bit 3 is larger than a diameter of the drill rod 1. A side wall of the drill rod 1 is provided with a first channel 11 communicating an interior of the clastic water storage bag 2 with the water supply channel 10. Through the first channel 11 and the water supply channel 10, water may be supplied into the clastic water storage bag 2 to expand it, or water in the expanded elastic water storage bag 2 may flow back to make the clastic water storage bag be shrunk. A first valve 51 is disposed in the first channel 11. For example, the first valve may be a solenoid valve, and the on-off of the first channel 11 may be controlled via the first valve 51. Preferably, the first channel 11 is arranged along a radial direction of the drill rod 1. The drill rod 1 in the head region is provided with a second channel 12 communicating the water supply channel 10 with the outside of the drill rod 1. Through the second channel 12 and the water supply channel 10, water may be supplied to the outside of the head region of the drill rod 1 to detect a water flowing fractured zone. In the embodiment of the present application, the second channel 12 is located on the side wall of the drill rod 1 and is arranged along the radial direction of the drill rod 1. In an alternative embodiment of the present application, the second channel 12 is formed by an end head of the drill rod and a hole in the drill bit 3 so that the water in the water supply channel 10 flows out from the end head of the drill rod 1 and the hole in the drill bit 3. A first flowmeter 61 is disposed in the water supply channel 10 between the second channel 12 and the clastic water storage bag 2 to measure flow data of water supplied from the water supply channel 10 to the second channel 12, and a second valve 52 is also provided to control the on-off of the water supply channel 10. A water return pipeline 7 is arranged between the head region and the tail region of the drill rod 1, and the water return pipeline 7 passes through the elastic water storage bag 2 and communicates the outside of the head region with the outside of the tail region of the drill rod 1 when the elastic water storage bag 2 is expanded to close the drill hole so that water for the test may flow out. In order to measure the flow of the returned water, a second flowmeter 62 is disposed in the water return pipeline 7.

When the automatic detection function-integrated detection apparatus for the water flowing fractured zone provided by the embodiment of the present application is used, the drill rod 1 is installed with the drill bit 3 and connected to the drilling machine 4, the first valve 51 is closed, the second valve 52 is opened, and after drilling to a position needed to be detected, drilling is stopped and a drill hole is formed. At this moment, the first valve 51 is opened, the second valve 52 is closed, and the clastic water storage bag 2 is filled with water through the water supply channel 10 in the drill rod 1 and the first channel 11 to expand the elastic water storage bag 2. The drill hole is plugged, and a closed space (an annular space between the head region of the drill rod and an inner wall of the drill hole) is formed between the clastic water storage bag 2 and an innermost end of the drill hole. Then, the first valve 51 is closed, the second valve 52 is opened, and water is supplied to the closed space through the water supply channel 10 and the second channel 12 until the water in the closed space flows from the water return pipeline 7 to the tail region of the drill rod 1. In this process, the condition of the water flowing fractured zone at the tested position may be determined through the flow data of the first flowmeter 61 and the second flowmeter 62.

Therefore, when the automatic detection function-integrated detection apparatus for the water flowing fractured zone provided by the embodiment of the present application is used, it is not necessary to first use a drill rod to make a drill hole and then use the drill rod to send a measurement apparatus for measurement as in the prior art. When the automatic detection function-integrated detection apparatus for the water flowing fractured zone provided by the embodiment of the present application is used, the whole detection process only needs to install the drill rod to drill to form a drill hole, and when drilling to the position needed to be detected, the water flowing fractured zone may be detected at the same time without disassembling the drill rod, thus the labor intensity and test time of workers are greatly reduced.

In addition, in the prior art, a rubber pipe is generally used to inject water into the water bag, and when the drill rod moves in the drill hole, the rubber pipe inevitably rubs against the drill hole wall, which is prone to phenomena such as abrasion and extrusion of the rubber pipe, resulting in the inability to continue the detection. In addition, in the automatic detection function-integrated detection apparatus for the water flowing fractured zone provided by the embodiment of the present application, water is supplied to the elastic water storage bag 2 through the water supply channel 10 inside the drill rod 1 and the first channel 11, which does not cause the phenomena such as abrasion and extrusion of the rubber pipe in the prior art, and the service life of the detection apparatus for the water flowing fractured zone and the integrity of the detection project are improved.

When a water flow in the closed space is tested per unit time, a pressure of the closed space plays a decisive role in the water flow. In order to reasonably determine and stabilize a hydrostatic pressure of a plugging section and reduce an error of the water flow test, in a preferred embodiment of the present application, a first overflow valve 81 is disposed in the water return pipeline 7. The function of the first overflow valve 81 is that when the water pressure in the closed space reaches a predetermined value, water flows out from the first overflow valve 81 to maintain the water pressure in the closed space at the predetermined value. The hydrostatic pressure of the plugging section may be determined and stabilized through the first overflow valve 81, the disadvantage that it is difficult to determine the hydrostatic pressures of the test points when the traditional double-end water plugging device tests long, high, and inclined drill holes is eliminated, at the same time the interference caused by the pressure fluctuation in the closed space is eliminated, and the error of the water flow test is reduced. The above-mentioned predetermined value is based on actual needs and is not limited by the embodiments of the present application.

In a preferred embodiment of the present application, a middle portion of the first channel 11 is connected to a third channel 13, and a terminal end of the third channel 13 is communicated with the outside of the tail region. A second overflow valve 82 is disposed in the third channel 13. Through the second overflow valve 82, it is ensured that when the water pressure in the clastic water storage bag 2 exceeds the predetermined value, water flows out from the second overflow valve 82 to maintain the water pressure in the elastic water storage bag 2 at the predetermined value. By setting an opening pressure of the second overflow valve 82, the elastic water storage bag 2 may be expanded to close the drill hole while preventing the damage due to the water pressure in the clastic water storage bag 2 exceeding the its bearing pressure.

In an alternative embodiment of the present application, the water return pipeline 7 may be located outside the drill rod 1. For example, the water return pipeline may be a straight pipe, which passes through the clastic water storage bag 2 and communicates the outside of the head region (the closed space) with the outside of the tail region of the drill rod 1, allowing the water to flow out from the closed space and testing its flow through the second flowmeter 62. In a preferred embodiment of the present application, in order to prevent the rotation of the drill rod 1 from wearing the water return pipeline 7, the water return pipeline 7 is U-shaped and includes a first pipe 71, a second pipe 72, and a third pipe 73 which are vertically connected to each other. The first pipe 71 and the third pipe 73 are located in the side wall of the drill rod 1 in the head region and the tail region, and the second pipe 72 is located in the water supply channel 10 and passes through the clastic water storage bag 2 from the interior of the drill rod 1.

In an alternative embodiment of the present application, a drill rod controller 9 is disposed at an outer side of the drill rod 1 and is connected to the first flowmeter 61, the second flowmeter 62, the first valve 51, and the second valve 52. Preferably, the drill rod controller 9 is fixedly disposed in a groove at the outer side of the drill rod 1 to prevent the drill rod controller from being worn during the rotation of the drill rod 1. Further preferably, the drill rod controller 9 is connected to an external control apparatus 91, which may be connected in a wireless or wired manner to make an operator to control the drill rod controller 9 outside the drill rod 1. When the drill rod controller and the external control apparatus are connected in a wired manner, a cable may be connected to the drill rod controller 9 through the water supply channel 10, the cable is prevented from being worn during the rotation of the drill rod 1.

In an alternative embodiment of the present application, the drill rod controller 9 may be a combination structure of a common commercially available circuit board with an explosion-proof and water-proof housing and an explosion-proof battery, welded in the groove at the outer side of the drill rod, and connected to all valves and flowmeters in the drill rod by using water-proof wires to control the opening of the valves and obtain flow data of the flowmeters. The external control apparatus 91 may be a combination structure of a common commercially available circuit board with an explosion-proof and water-proof housing and an explosion-proof battery, and connected to an end part of the tail region of the drill rod through a magnetic metal. The drill rod is used as a signal transmission medium, and the external control apparatus is connected to the drill rod controller through a single wire transmission protocol, the drill rod controller can be remotely controlled and data collected by the drill rod controller is obtained.

When a drill hole depth is too large for the drill rod to reach, in an alternative embodiment of the present application, a terminal end of the drill rod 1 in the tail region is connected to one end of a transfer drill rod (not shown in the drawings) via threads, and the other end of the transfer drill rod is connected to the drilling machine to lengthen the drill rod 1, so that when the drill hole depth is too large, the detection of the water flowing fractured zone can also be completed.

In a second aspect, an automatic detection function-integrated detection method for a water flowing fractured zone is provided by the embodiment of the present application, the above-mentioned automatic detection function-integrated detection apparatus for the water flowing fractured zone is adopted, and the method includes the following steps.

In step A, the terminal end of the head region of the drill rod 1 is connected to the drill bit 3, and the terminal end of the tail region is connected to the drilling machine 4. Water is introduced into the water supply channel 10, the first valve 51 is kept closed, and the second valve 52 is opened. The drilling machine 4 is started to drill into a rock stratum 102 above a coal scam 101 (the coal seam 101 and the rock stratum 102 may be referred to FIG. 2) to a position needed to be detected, and then drilling is stopped. In this step, the external control apparatus 91 is connected to the drill rod 1 before drilling, the signal connectivity between the external control apparatus 91 and the drill rod controller 9 is tested, and water is introduced to test whether the first valve 51, the second valve 52, the first flowmeter 61, and the second flowmeter 62 work normally.

In step B, the drill rod controller 9 is controlled through the external control apparatus 91 outside the drill hole, so that the drill rod controller 9 closes the second valve 52 and opens the first valve 51. The elastic water storage bag 2 is filled with water through the first channel 11 to expand the clastic water storage bag 2 outwards and close the drill hole.

In step C, the drill rod controller 9 is controlled through the external control apparatus 91 outside the drill hole so that the drill rod controller 9 opens the second valve 52 and closes the first valve 51. Water is imported into the closed space between the head region and the drill hole through the second channel 12, and the water is flowed out to the tail region through the water return pipeline 7 after the closed space is filled with water.

In step D, flow data of the first flowmeter 61 and the second flowmeter 62 per unit time are recorded to obtain a first flow value and a second flow value.

In step E, supplying water into the water supply channel 10 is stopped, and the drill rod controller 9 is controlled through the external control apparatus 91 outside the drill hole, so that the drill rod controller 9 opens the first valve 51. The water in the clastic water storage bag 2 flows out under the squeezing action of the elastic force, and after the elastic water storage bag 2 is closely attached to the drill rod, the first valve 51 is closed, and the drilling is continued to a next test position.

In an alternative embodiment of the present application, the control apparatus outside the drill hole is used to control the drill rod controller by using the drill rod as the signal transmission medium. After the drill rod reaches the position to be detected, detection may be carried out on the spot without disassembling the drill rod. The drill rod controller is used to control the opening and closing of the first valve and the second valve in the drill rod and acquire data of the first flowmeter and the second flowmeter, so that an amount of water loss per unit length of the drill hole per unit time may be quickly and accurately obtained, thereby a development degree of a fracture at a specific position is determined. Compared with the existing methods, the operation steps are greatly simplified and the labor intensity of workers is reduced in the embodiments of the present application.

In an alternative embodiment of the present application, in the step A, a maximum development height of the water flowing fractured zone is first calculated, and a maximum length of the drill hole is determined. A height of the water flowing fractured zone of overlying strata on a mining field of a working face may be calculated according to the formula in the "Regulations on the Retention of Coal Pillars in Buildings, Water Bodies, Railways, and Main Shafts and the Extraction of Pressed Coal", and then the maximum length of the drill hole with a known angle is obtained according to a trigonometric function.

In an alternative embodiment of the present application, in the step B, the elastic water storage bag 2 is filled with water through the first channel 11 until the second overflow valve 82 in the third channel 13 connected to the first channel 11 is opened and a signal is fed back to maintain the water pressure in the elastic water storage bag 2 to reach a suitable predetermined value.

In an alternative embodiment of the present application, in the step C, after the first overflow valve 81 in the water return pipeline 7 is opened and a signal is fed back, the step D is performed. The function of the first overflow valve 81 is that when the water pressure in the closed space reaches the predetermined value, water flows out from the first overflow valve 81 to maintain the water pressure in the closed space at the predetermined value. The hydrostatic pressure of the plugging section may be determined and stabilized through the first overflow valve 81, the interference caused by the pressure fluctuation in the closed space is eliminated, and the error of the water flow test is reduced. In the step D, the water pressure in the closed space exceeds the limit of the first overflow valve 81, the second flowmeter 62 starts to count, and the first flowmeter 61 starts to count synchronously. A difference between the flows of the first flowmeter 61 and the second flowmeter 62 per unit time is the amount of water loss in the closed space per unit time, and the data are recorded as the first flow value and the second flow value.

In an alternative embodiment of the present application, in the step D, whether the position needed to be detected contains a fracture is determined based on a ratio of the first flow value to the second flow value, a development degree 4 of the fracture is acquired at the position needed to be detected, and a calculation formula of the development degree 4 of the fracture is as follows:

$$\frac{q_1}{q_2} \cdot k = \Delta.$$

A is a development degree of a fracture of a drill hole detection section, $q_1$ is the second flow value, $q_2$ is the first flow value, and k is a pressure correction coefficient.

When $\Delta \geq 0.9$, the fracture of the drill hole detection section is almost undeveloped, and a drill hole detection position is determined to be in a complete section.

When $0.9 > \Delta \geq 0.5$, the development degree of the fracture of the drill hole detection section is slow, and it is determined that there is a fracture at the drill hole detection position, but the development degree of the fracture is not serious.

When $0.5 > \Delta \geq 0.2$, the development degree of the fracture of the drill hole detection section is relatively serious, and the drill hole detection position is determined to be close to a development range of the water flowing fractured zone.

When $\Delta < 0.2$, the development degree of the fracture of the drill hole detection section is serious, and the drill hole detection position is determined to be in the development range of the water flowing fractured zone.

In an alternative embodiment of the present application, the pressure correction coefficient k may be 1.

In an alternative embodiment of the present application, the pressure correction coefficient k is used when different pressures are selected for the plugging section, and is determined by field experiments combined with the Bernoulli equation. The Bernoulli equation is described as follows. Under the same working condition, when the pressure of the plugging section is $p_1$, a flow rate $v_1$ may be obtained, and when the opening pressure of the first overflow valve is modified to $p_2$, a flow rate $v_2$ may be obtained.

Thus, when different opening pressures are selected for the first overflow valve, the pressure correction coefficient k is $v_1/v_2$:

$$\frac{p}{\rho}+\frac{v^2}{2}+gh=c.$$

Wherein p is the water pressure of the plugging section, which may be taken as the opening pressure of the first overflow valve, p is the water density, v is a flow rate of water to the fractured zone, g is the gravitational acceleration, h is a water flow height at the detection position, and c is a constant.

Figure 3:
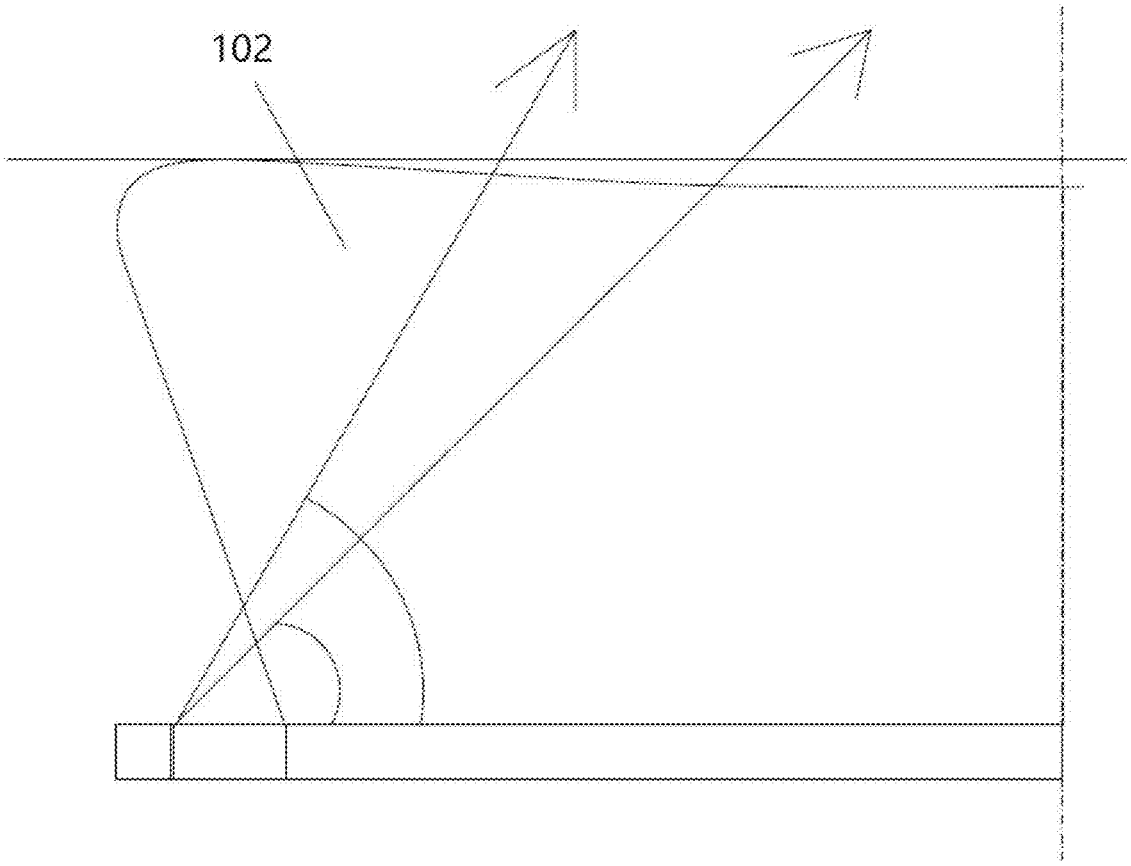
FIG. 3 is a schematic diagram of a setting direction of a drill hole of an automatic detection function-integrated detection apparatus for a water flowing fractured zone in use according to an embodiment of the present application.

Referring to FIG. 3, FIG. 3 is a schematic diagram of a setting direction of a drill hole of an automatic detection function-integrated detection apparatus for a water flowing fractured zone in use according to an embodiment of the present application. FIG. 3 shows that an included angle between a drilling direction (arrow direction) of the drill rod 1 and a horizontal direction is 45-60 degrees, which has been verified many times and may effectively protect the coal pillar.

Figure 4:
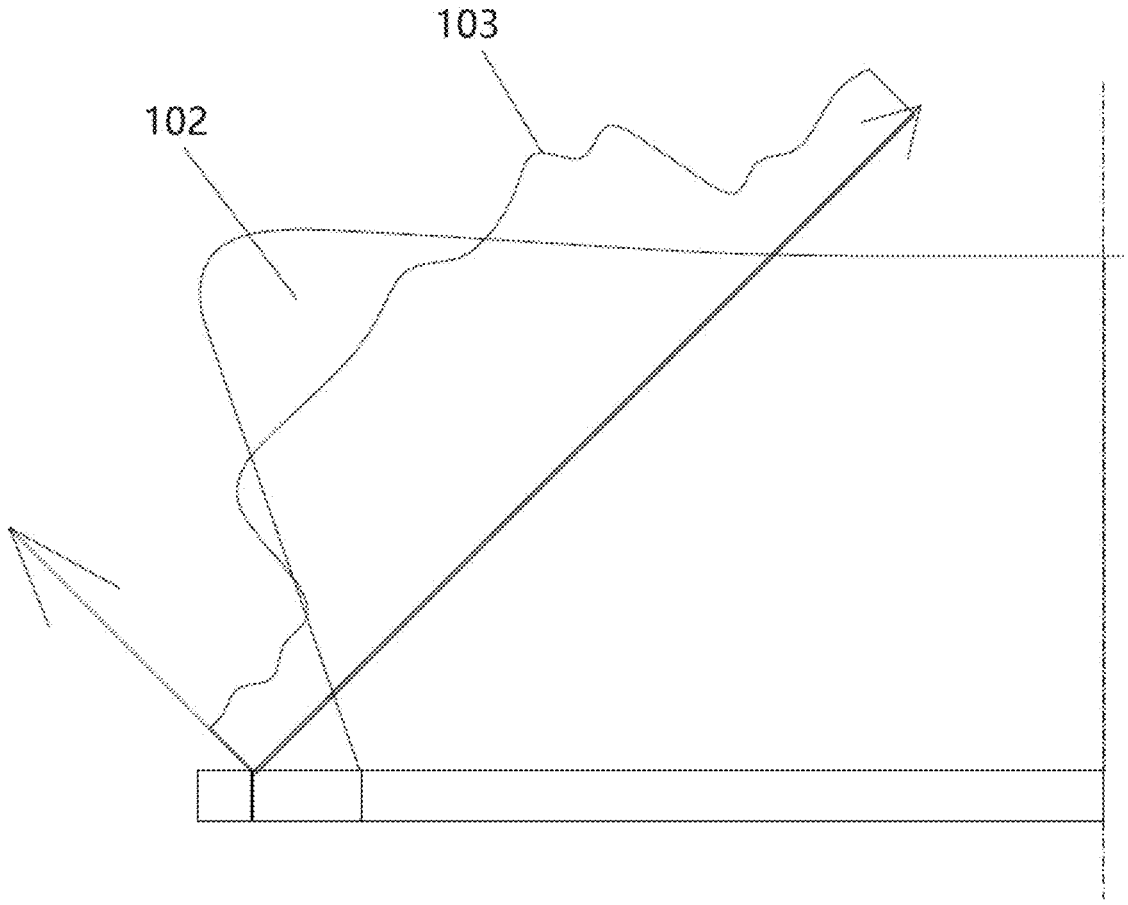
FIG. 4 is a schematic diagram of a predicted water flow of an automatic detection function-integrated detection apparatus for a water flowing fractured zone in use according to an embodiment of the present application.

Referring to FIG. 4, FIG. 4 is a schematic diagram of a predicted water flow of an automatic detection function-integrated detection apparatus for a water flowing fractured zone in use according to an embodiment of the present application. FIG. 4 shows the required water flow (the direction of the arrow at the left side in the figure) along a drilling direction (the direction of the arrow at the right side in the figure) in the water flowing fractured zone, and the change of the water flow is shown in a curve 103 between the directions of the two arrows in the figure. At the outside of the water flowing fractured zone, the required water flow is relatively small. In the interior of the water flowing fractured zone, since there is a fracture, water will be consumed, and thus the required water flow is relatively large.

The advantages of the automatic detection function-integrated detection apparatus and method for the water flowing fractured zone provided by the embodiments of the present application are as follows.

Firstly, the traditional double-end water plugging device test apparatus needs to complete the drill hole first, and then send the test apparatus connected to the drill hole to the designated location for measurement. The whole process needs to disassemble the complete drill rod twice, the labor intensity and time of workers are greatly increased. Meanwhile, it is easy to cause the collapse of the drill hole in the long detection process, resulting in detection failure. A detection system is integrated onto a drill rod in the embodiments of the present application, so that detection may be completed while a drill hole is drilled, measurement time is saved and the labor intensity of workers is reduced at the same time.

Secondly, the consistency of water pressure in the closed section is an important condition to ensure the accuracy of the test, and it is very difficult to manually ensure the consistency of water pressure in the closed section when the traditional double-end water plugging device is used to test long and high drill holes. The detection apparatus provided by the embodiments of the present application uses an overflow valve to control the water pressure in the closed section to ensure the consistency of water pressure in the closed section during the whole detection process, thereby the accuracy of detection is ensured.

Thirdly, whether the elastic water storage bag can be filled with water and expanded to close the drill hole is a prerequisite for ensuring the success of detection, and the traditional double-end water plugging device needs an external water pipe when the water bag is filled with water. Moreover, whether the rubber bag is expanded to close the drill hole can only be judged manually and empirically. During long-distance detection, the external water pipe is prone to wear out, or the water bag cannot be expanded to close the drill hole when the water pressure is too small, and the water bag ruptures when the water pressure is too large. The detection apparatus provided by the embodiments of the present application uses the cooperation of solenoid valves and omits the external water pipe. Meanwhile, overflow valves are disposed to ensure a reasonable pressure of the water in the clastic water storage bag, so that the elastic water storage bag may be expanded to an appropriate degree, that the elastic water storage bag may successfully close the drill hole is ensured, and the accuracy of detection is ensured.

Fourthly, when the detection apparatus provided by the embodiments of the present application is used for detecting, the amount of water loss per unit time is completely read and obtained by an electronic device, the error caused by manual reading is avoided, and the reliability of data during detection is ensured.

Fifthly, the detection apparatus provided by the embodiments of the present application may be used in combination with an existing drilling machine and drill bit, with good adaptability.

Sixthly, the detection apparatus provided by the embodiments of the present application abandons the redundancy of the traditional double-end water plugging device in measuring the water flowing fractured zone that the drill hole needs to be completed first, and then the test apparatus is sent into the drill hole for monitoring, as well as the inaccuracy of manually determining measurement parameters and reading measurement results. The external control apparatus is used to control the drill rod controller by using the drill rod as the signal transmission medium. The drill rod controller is used to control the opening and closing of the valves in the integrated detection drill rod and acquire the data of the flowmeters, so that the amount of water loss per unit length of the drill hole per unit time may be quickly and accurately obtained, thereby the development degree of the fracture at the specific position is determined.

Reference herein to "one embodiment", "an embodiment", or "one or more embodiments" means that a particular feature, structure, or characteristic described in connection with the embodiment is included in at least one embodiment of the present application. In addition, it is noted that examples of the word "in one embodiment" herein are not necessarily all referring to the same embodiment.

In the description provided herein, numerous specific details are set forth. However, it is understood that the embodiments of the present application may be practiced without these specific details. In some instances, well-known methods, structures, and techniques have not been shown in detail in order not to obscure the understanding of this description.

Finally, it should be noted that: the above-mentioned embodiments are merely used to illustrate the technical solutions of the present application and are not limited to them; although the present application has been described in detail with reference to the foregoing embodiments, a person skilled in the art will appreciate that: the technical solutions recorded in the foregoing embodiments may still be modified, or some of the technical features thereof may be replaced by equivalents; however, these modifications or replacements do not make the essence of the corresponding technical solutions detached from the spirit and scope of the technical solutions of the embodiments of the present application.

What is claimed is:

1. An automatic detection function-integrated detection apparatus for a water flowing fractured zone, comprising:

a drill rod and an elastic water storage bag located at a periphery of a middle portion of the drill rod, wherein a region of the drill rod covered by the elastic water storage bag is a plugging region, and two sides of the plugging region are a head region and a tail region, respectively;

an interior of the drill rod has a water supply channel arranged in an axial direction; a terminal end of the head region is provided with a drill bit, and a terminal end of the tail region is configured to connect a drilling machine;

a side wall of the drill rod is provided with a first channel communicating an interior of the elastic water storage bag with the water supply channel, and a first valve is disposed in the first channel;

the drill rod in the head region is provided with a second channel communicating the water supply channel with an outside of the drill rod, and a first flowmeter and a second valve are disposed in the water supply channel between the second channel and the elastic water storage bag;

a water return pipeline is arranged between the head region and the tail region of the drill rod, and the water return pipeline passes through the elastic water storage bag and communicates an outside of the head region of the drill rod with an outside of the tail region of the drill rod; and a second flowmeter is disposed in the water return pipeline.

2. The automatic detection function-integrated detection apparatus for the water flowing fractured zone according to claim 1, wherein a first overflow valve is disposed in the water return pipeline.

3. The automatic detection function-integrated detection apparatus for the water flowing fractured zone according to claim 2, wherein the water return pipeline is U-shaped and comprises a first pipe, a second pipe, and a third pipe;

wherein the first pipe, the second pipe, and the third pipe are vertically connected to each other;

the first pipe is located in the side wall of the drill rod in the head region, the third pipe is located in the side wall of the drill rod in the tail region, and the second pipe is located in the water supply channel; and/or a middle portion of the first channel is connected to a third channel, and a terminal end of the third channel is communicated with the outside of the tail region; and a second overflow valve is disposed in the third channel.

4. The automatic detection function-integrated detection apparatus for the water flowing fractured zone according to claim 2, wherein a drill rod controller is disposed at an outer side of the drill rod and is connected to the first flowmeter, the second flowmeter, the first valve, and the second valve.

5. The automatic detection function-integrated detection apparatus for the water flowing fractured zone according to claim 2, wherein the elastic water storage bag is made of rubber; and/or a terminal end of the drill rod in the tail region is connected to a first end of a transfer drill rod via threads, and a second end of the transfer drill rod is connected to the drilling machine; and/or the first valve and the second valve are solenoid valves.

6. The automatic detection function-integrated detection apparatus for the water flowing fractured zone according to claim 1, wherein the water return pipeline is U-shaped and comprises a first pipe, a second pipe, and a third pipe;

wherein the first pipe, the second pipe, and the third pipe are vertically connected to each other; the first pipe is located in the side wall of the drill rod in the head region, the third pipe is located in the side wall of the drill rod in the tail region, and the second pipe is located in the water supply channel; and/or a middle portion of the first channel is connected to a third channel, and a terminal end of the third channel is communicated with the outside of the tail region; and a second overflow valve is disposed in the third channel.

7. The automatic detection function-integrated detection apparatus for the water flowing fractured zone according to claim 1, wherein a drill rod controller is disposed at an outer side of the drill rod and is connected to the first flowmeter, the second flowmeter, the first valve, and the second valve.

8. The automatic detection function-integrated detection apparatus for the water flowing fractured zone according to claim 7, wherein the drill rod controller is connected to an external control apparatus.

9. The automatic detection function-integrated detection apparatus for the water flowing fractured zone according to claim 1, wherein the elastic water storage bag is made of rubber; and/or a terminal end of the drill rod in the tail region is connected to a first end of a transfer drill rod via threads, and a second end of the transfer drill rod is connected to the drilling machine; and/or the first valve and the second valve are solenoid valves.

10. An automatic detection function-integrated detection method for a water flowing fractured zone, adopting the automatic detection function-integrated detection apparatus for the water flowing fractured zone according to claim 1 and comprising the following steps:

step A, connecting the terminal end of the head region of the drill rod to the drill bit, and connecting the terminal end of the tail region to the drilling machine; introducing water into the water supply channel, keeping the first valve closed, and opening the second valve; starting the drilling machine, drilling to a position needed to be detected, and then stopping drilling;

step B, controlling a drill rod controller on the drill rod through an external control apparatus outside a drill hole, so that the drill rod controller closes the second valve and opens the first valve; filling the elastic water storage bag with the water through the first channel to expand the elastic water storage bag outwards and close the drill hole;

step C, controlling the drill rod controller through the external control apparatus outside the drill hole, so that the drill rod controller opens the second valve and closes the first valve; importing the water into a space between the head region and the drill hole through the second channel, and flowing the water out to the tail region through the water return pipeline after the space is filled with the water;

step D, recording flow data of the first flowmeter and the second flowmeter per unit time to obtain a first flow value and a second flow value; and step E, stopping supplying the water into the water supply channel, and controlling the drill rod controller through the external control apparatus outside the drill hole, so that the drill rod controller opens the first valve; closing the first valve after the elastic water storage bag is closely attached to the drill rod, and continuing drilling to a next detection position.

11. The automatic detection function-integrated detection method for the water flowing fractured zone according to claim 10, wherein in the step A, a maximum length of the drill hole is determined by calculating a maximum development height of the water flowing fractured zone; and/or in the step B, the elastic water storage bag is filled with the water through the first channel until a second overflow valve in a third channel connected to the first channel is opened and a first signal is fed back; and/or in the step C, after a first overflow valve in the water return pipeline is opened and a second signal is fed back, the step D is performed.

12. The automatic detection function-integrated detection method for the water flowing fractured zone according to claim 10, wherein in the step D, whether the position needed to be detected contains a fracture is determined based on a ratio of the first flow value to the second flow value, a development degree Δ of the fracture is acquired at the position needed to be detected, and a calculation formula of the development degree Δ of the fracture is as follows:

$$\frac{q_1}{q_2} \cdot k = \Delta,$$

wherein Δ is the development degree of the fracture of a drill hole detection section, $q_1$ is the second flow value, $q_2$ is the first flow value, and k is a pressure correction coefficient;

when $\Delta \geq 0.9$, the fracture of the drill hole detection section is almost undeveloped, and a drill hole detection position is determined to be in a complete section;

when $0.9 > \Delta \geq 0.5$, the development degree of the fracture of the drill hole detection section is slow, and the fracture is determined to exist at the drill hole detection position, but the development degree of the fracture is not serious;

when $0.5 > \Delta \geq 0.2$, the development degree of the fracture of the drill hole detection section is relatively serious, and the drill hole detection position is determined to be adjacent to a development range of the water flowing fractured zone; and when $\Delta < 0.2$, the development degree of the fracture of the drill hole detection section is serious, and the drill hole detection position is determined to be in the development range of the water flowing fractured zone.

13. The automatic detection function-integrated detection method for the water flowing fractured zone according to claim 12, wherein the pressure correction coefficient k is 1.

14. The automatic detection function-integrated detection method for the water flowing fractured zone according to claim 10, wherein in the automatic detection function-integrated detection apparatus, a first overflow valve is disposed in the water return pipeline.

15. The automatic detection function-integrated detection method for the water flowing fractured zone according to claim 10, wherein in the automatic detection function-integrated detection apparatus, the water return pipeline is U-shaped and comprises a first pipe, a second pipe, and a third pipe;

wherein the first pipe, the second pipe, and the third pipe are vertically connected to each other;

the first pipe is located in the side wall of the drill rod in the head region, the third pipe is located in the side wall of the drill rod in the tail region, and the second pipe is located in the water supply channel; and/or a middle portion of the first channel is connected to a third channel, and a terminal end of the third channel is communicated with the outside of the tail region; and a second overflow valve is disposed in the third channel.

16. The automatic detection function-integrated detection method for the water flowing fractured zone according to claim 10, wherein in the automatic detection function-integrated detection apparatus, a drill rod controller is disposed at an outer side of the drill rod and is connected to the first flowmeter, the second flowmeter, the first valve, and the second valve.

17. The automatic detection function-integrated detection method for the water flowing fractured zone according to claim 16, wherein in the automatic detection function-integrated detection apparatus, the drill rod controller is connected to an external control apparatus.

18. The automatic detection function-integrated detection method for the water flowing fractured zone according to claim 10, wherein in the automatic detection function-integrated detection apparatus, the elastic water storage bag is made of rubber; and/or a terminal end of the drill rod in the tail region is connected to a first end of a transfer drill rod via threads, and a second end of the transfer drill rod is connected to the drilling machine; and/or the first valve and the second valve are solenoid valves.

* * * * *